US005786556A

United States Patent [19]

Grönlund et al.

[11] Patent Number: 5,786,556

[45] Date of Patent: Jul. 28, 1998

[54] METHOD AND A DEVICE FOR PICKLING OF STAINLESS STEEL

[75] Inventors: Conny Grönlund, Göteborg; Kaj Grönlund, Avesta, both of Sweden

[73] Assignee: Swedish Pickling AB, Gothenburg, Sweden

[21] Appl. No.: 553,473

[22] PCT Filed: May 4, 1994

[86] PCT No.: PCT/SE94/00406

§ 371 Date: Dec. 25, 1995

§ 102(e) Date: Dec. 25, 1995

[87] PCT Pub. No.: WO94/26959

PCT Pub. Date: Nov. 24, 1994

[30] Foreign Application Priority Data

May 9, 1993 [SE] Sweden ..... 9301591

[51] Int. Cl.[6] ..... C25F 1/06; C25F 7/00

[52] U.S. Cl. ..... 205/705; 205/712; 205/714; 204/206; 204/207; 204/208

[58] Field of Search ..... 205/705, 712, 205/714; 204/206, 207, 208

[56] References Cited

U.S. PATENT DOCUMENTS 5,425,862 6/1995 Hartmann et al. ..... 204/207

FOREIGN PATENT DOCUMENTS 59-85892 5/1984 Japan ..... 204/207

*Primary Examiner*—Arun S. Phasge
*Attorney, Agent, or Firm*—John Lezdey

[57] ABSTRACT

A method and a device for performing the method of electrolytic pickling of a metal strip. The metal strip continuously passes through an electrolyte bath which has an electrolyte circulating through a closed system. Crevices are formed on both sides of the metal with electrodes which are located above the top crevice and below the bottom crevice. The electrodes are of opposite polarity and are chemically resistant to the electrolyte. An electrical current is passed from one electrode, through one crevice, through the metal, through the other crevice and to the other electrode which results in the electrolytic pickling of the metal.

16 Claims, 3 Drawing Sheets

METHOD AND A DEVICE FOR PICKLING OF STAINLESS STEEL

This application is a 371 continuation of PCT/SE94/00406 filed May 4, 1994.

BACKGROUND OF THE INVENTION

1. Field of the Invention

The present invention relates to a method for removal of oxide layers, chromium depleted zones and the like in pickling of a metal, in the first place stainless steel, more particularly high alloy stainless steel in the form of plates or strips, continuously passing in an electrolytic bath. The invention also relates to a device for performing said method.

2. Decsription of the Prior Art

The development of new high alloy stainless steel, both austenitic and ferritic-austenitic steels, requires new or improved pickling methods. The methods used up to now are principally the same used for some decades for lower alloyed stainless steels.

A known pickling technique is pickling in different mineral acids or mixtures of acids. Further electrolytic pickling in neutral salt solutions is used, see the Swedish patent 205 105.

Electrolytic pickling in mineral acids or mixtures of acids is used to get a fast pickling in continuous annealing/pickling lines, where the process control is related to the strip speed, see report by S Owada et al, A new electrolytic descaling in $HNO_3$—HCl acid for development of functional stainless steels; in Proc. International Conference on Stainless Steels, 1991, Chiba, ISIJ, p 937. Electrolytic pickling with alternating current in mineral acids or mixtures of acids is also known according to the Swedish patent 132 298.

For high alloy stainless steel the mentioned methods have problems both in obtaining a clean surface without any annealing oxide and in removing the chromium depleted zone, about 2–20μm deep, below the annealing oxide. For the new high alloy stainless steels and their demanding applications it is of outmost importance that the surface has the properties of the alloy, that the composition is perfect in the surface, thus that the chromium depleted zone has been removed. The lower chromium content in the surface zone means a considerable deterioration of the surface properties, e. g. the pitting resistance, compared to the properties of the bulk material below the surface. The critical pitting temperature in potentiodynamic test in 1M NaCl is for several high alloy steels over 90° C. in the bulk material, but in presence of a chromium depleted zone in the surface the critical pitting temperature can be only 70° C. in the surface. It is known that if pitting once has started in the deteriorated surface zone, the pitting attacks will continue down to material with the right composition. Grinding has been tested to remove the chromium depleted zone, but causes microcrevices in the surface and impurities from the grinding belt and thus deteriorated corrosion properties in the new surface.

The industry has even been forced to accept a certain chromium depletion in the surface of high alloy steels due to the pickling problems, see report by J F Grubb, in Proc. International Conf. Stainless Steels, 1991, Chiba, ISIJ, p 944.

The industry has also tried to and still tries to solve the process technical problems by combining several different pickling methods in a production line, e. g. electrolytic pickling in neutral salt solution, followed by mixed acid pickling. Further, mechanical stages as shot blasting, brushing and possibly grinding are often included.

For mixed acid pickling, in which a high speed (e. g. 30 m/min) is used in continuous processes for passing through the furnace, long pickling baths, high acid concentrations and high temperature are required to manage to achieve an acceptable pickling effect. This means a great strain on handling and environment. Big volumes of acids, HF and $HNO_3$, and big volumes of air with reaction gases, nitrogen oxides , must be handled in refining and retardation stages. For the high alloy stainless steels a final pickling according to this method cannot manage the previously mentioned problem with chromium depletion in the surface.

Electrolytic pickling in neutral salt solutions gives an improved environmental technique, but the process is only used to break up oxide layers. Final pickling must be performed as mixed acid pickling, where the effect of the process is limited according to the paragraph above. A metallurgical drawback for high alloy stainless steel is also that pitting can occur in the electrolytic pickling stage. In application of the electrolytic process, the material is the centre conductor and the material passes a series of electrode pairs comprising in turn anode/anode , cathode/cathode, anode/anode etc. Thus, the electrode pairs have mutually the same polarity and voltage and they are placed at both sides of the strip travelling through the bath.

For electrolytic pickling in acid it is known that in a laboratory scale, where the voltage between the electrolyte and a steel specimen is controlled by a reference electrode, the pickling process can be controlled to selective pickling of the oxide layer and the chromium depleted zone , respectively. This method cannot be used in industrial scale for a continuous pickling process for strip with a heterogeneous chemical potential, because material with oxide would be fed into the pickling bath simultaneously with a completely pickled material being fed out of the bath.

Electrolytical pickling by alternating current and mineral acids or mixed acids as electrolyte is a known old technique described in the Swedish patent 132 298 among others. In examples a method used for static pieces to be pickled, e. g. plates hanging in the acid, is described. One of the plates can be one of the electrodes, which subsequently will also be pickled. It is also mentioned in the description to use several plates in the same electrolyte, alternatingly connected to the power source. Further, there are examples, where the centre conductor principle with liquid contact between electrode and plate is used. However, they recommend that the strip should not be used as a centre conductor and liquid contact, instead the product to be pickled (the strip) should be connected as an electrode. There is not any special description of how to do this connection.

For a person skilled in the art it would be natural to connect the power supply via sliding contacts, metal rolls or the like. The mentioned patent says that the electrode material is preferably stainless material. Then a problem is that stainless electrodes, which are preferred in said patent, are consumed in the same proportion and speed as the pickled product (the strip) and a high consumption of electrodes will give problems in continuous processes. Furthermore acid is consumed for the pickling of electrodes. Further a non-negligible potential decrease will be obtained between stainless electrodes and the electrolyte, which gives problems with increased temperature of the electrolyte, contrary to what is stated in the mentioned patent.

A known technique for continuous passage of strip horizontally through electrolytic baths is to use open baths, where the strip is pressed below the electrolyte surface by guiding rolls, which must be isolated by rubber, plastic or the like. The open baths involve environmental problems. As the strips can be more or less unflat, both longitudinally and widthwise, and their surfaces can have certain defects and irregularities, the rolls are exposed to both chemical attack and mechanical wear and all this requires exchanges of the rolls and subsequently production stops.

Another known technique is to feed the strip into an opening in the wall of the bath and tighten from the inside with couples of opposed steel rolls, dressed with rubber or plastic etc., at the bath wall. As a consequence, the rolls , which must have a great diameter to level any knobs and dents in the strip, are closely pressed against the strip surface to tighten any leak of strong process solution through the wall opening or in the crevice between the rolls and the strip. Further, the roll coating often is exposed to solutions of high temperature, which causes a faster break down of the coating. Thus, the wear of the coating of the rolls can be big, and the exchanging of the rolls causes long process stops and breaks of production flows.

In common, the prior art bath constructions have tightening means, being fully or partly immersed in the process solution and having the function to guide the position of the strip. In summary, the greatest problems with the known technique for passage of a strip in a pickling bath are

- immense wear of the tightening means (the roll coating) both mechanically, due to the surface condition of the strip and the knobs and dents in the strip surface, and chemically, due to strong process solutions, e. g. strong acids, at high temperatures
- drift stop for exchange of rolls.

The object of the invention is to provide a total solution of the process technical problems in pickling of stainless steel strips, particularly of high alloy stainless steel, which pass continuously in an electrolytic bath, and to attain both a clean pickled surface and the correct surface composition and still meet both productional and environmental demands as to prevent any leak of strong process solutions and reaction products. The invention is a solution of these problems.

SUMMARY OF THE INVENTION

According to the present invention, there is provided a device and method thereof for electrolytic pickling of a metal. The device includes an electrolyte bath having an electrochemical cell and an electrolyte circulating through a closed system. The electrochemical cell has two cell halves and two electrodes, each cell half containing one of the electrodes. The electrodes have opposite polarities and are chemically resistant to the electrolyte. Viewing the device from the bottom on up, there is located one of the electrodes, a crevice, the metal, another crevice and the other electrode. Preferably, means for tightening the metal as it passes through the electrochemical cell are also provided. The electrolytic pickling is accomplished by passing an electrical current from one electrode, through the bordering crevice, through the metal, through the other crevice and to the other electrode.

The invention can be used in a separate pickling line for strips having uncoiler/recoiler or for plates fed into the pickling device via a roller table. The invention can also be a part of a continuous rolling/annealing/pickling line, alternatively an annealing/pickling line.

As several stages in a complete pickling line are well-known , e. g. rinsing and drying, the electrochemical cell and the electrolyte flow, only, are shown in the following description of embodiments. A number of cells according to the invention should be placed in a series in a strip line to manage pickling at a speed equal to that of the other process stages. The size of the cells can also be varied. In a pickling line consisting of more cells, fully individual parameters (electrolytes, voltage, current density, direct current or alternating current) can also be used in different cells according to the invention.

BRIEF DESCRIPTION OF THE DRAWINGS

One embodiment of the device according to the invention is shown schematicly in the drawings, where.

DESCRIPTION OF THE PREFERRED EMBODIMENTS

Figure 1:
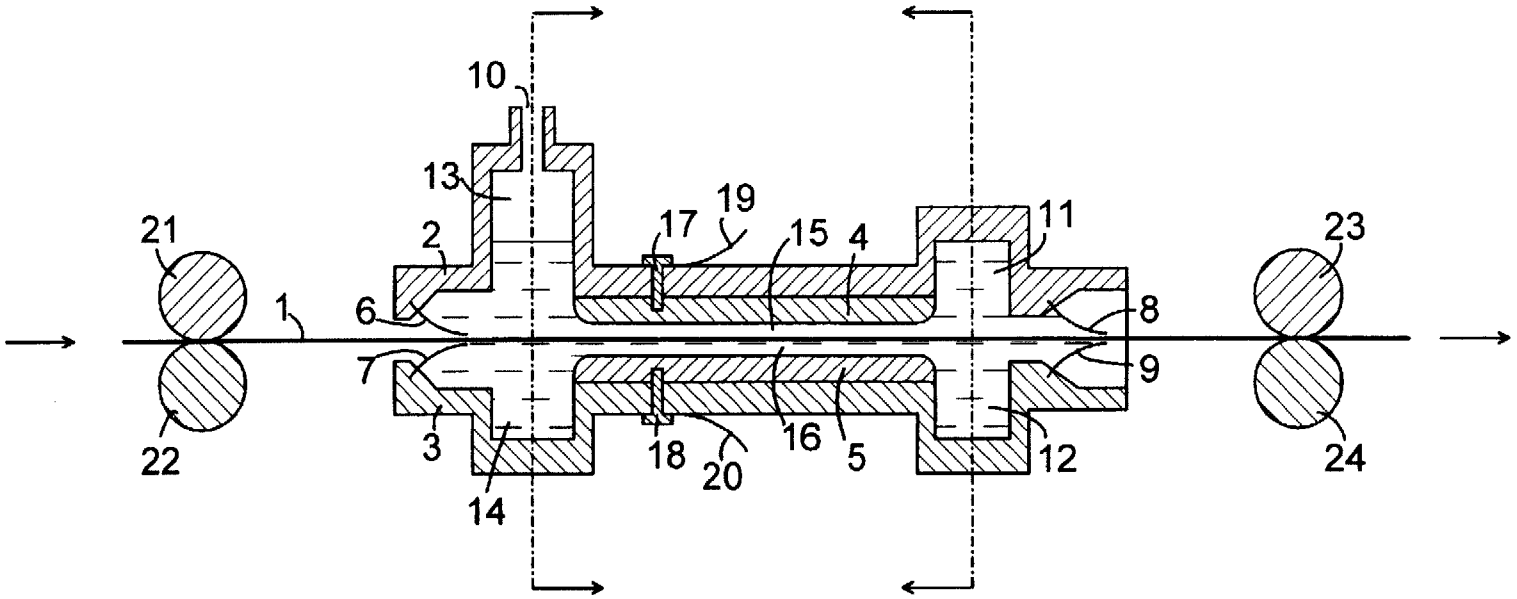
FIG. 1 shows a section, in the feeding direction of the strip, through a cell for electrolytic pickling.

The following components are shown in FIG. 1, an electrochemical cell consisting of two cell halves 2,3, made of chemically resistant material, above and below a strip 1. The cell halves contain two plates of graphite electrodes 4,5 and tightening means 6–9, which tighten the inlets and outlets of the strip in the cell. The electrolyte is sucked into the cell via transverse inlet channels 11,12 and is sucked further through a thin crevice 15 above the strip and a thin crevice 16 below the strip and leaves the cell via transverse outlet channels 13,14. Screws 17, 18 keep the graphite electrodes in place and connect them electrically to a not shown alternating current power supply via cable 19 to one pole and via cable 20 to the other pole. Outside the cell there are guidance rolls 21–24 to keep the stretched strip 1 positioned between the cell halves 2,3. It should be noted that the figure shows just one screw and cable per graphite electrode, but to transfer high currents, a great number of screws/cables is required.

Figure 2:
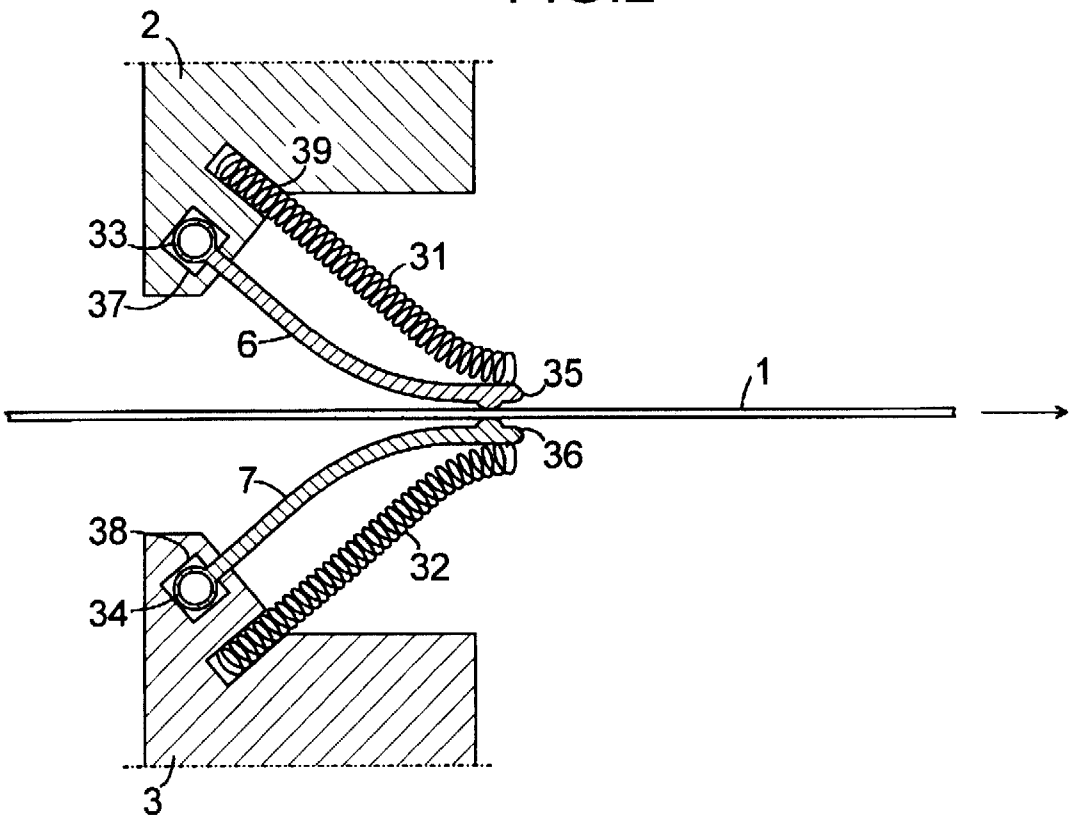
FIG. 2 shows a section of the tightening means and FIGS. 3A and 3B show two sections of the cell perpendicularly to the feeding direction of the strip and here it is apparent how the electrolyte circulates in the cell.

FIG. 2 shows a section of a couple of tightening means 6,7, preferably made as strips, at the inlet of the strip in the cell. There are corresponding tightening means 8,9 at the outlet of the strip (see FIG. 1). The tightening strips are made of strandblown rubber with a straight profile in the centre and one edge 35,36 reinforced against wear caused by the metal strip. The other edge 33,34 has a round profile with a hole in the centre to fit into a track 37,38, in the cell half 2,3 for holding of the list, resp. Springs 31,32 are made as straight, dense spiral springs and by their assemblage the tightening strips are always pressed against the strip 1. By this shape of the tightening means 6–9, it has surprisingly turned out that not even strips with bad flatness by knobs, dents and surface defects are able to open the tightening means to an extent giving any problems with leak of acid. The wear in points 35,36 and correspondingly at the outlet, has also turned out to be small, in spite of the passage of several kilometers of strip per hour. At their outlet through the cell wall, the tightening strips pass end pieces, which are not shown in the figures. The tightening strips can be exchanged, during running of the pickling line, by pulling fresh strip into tracks 37,38, from a supply roll, not drawn, beside the cell, by means of the old worn strip being pulled out of the cell and being cut off. The number of springs per tightening strip may be 100 per meter, and it has turned out that the springs, by their assemblage, are not causing any problems when exchanging the tightening strip.

Figures 3A, 3B:
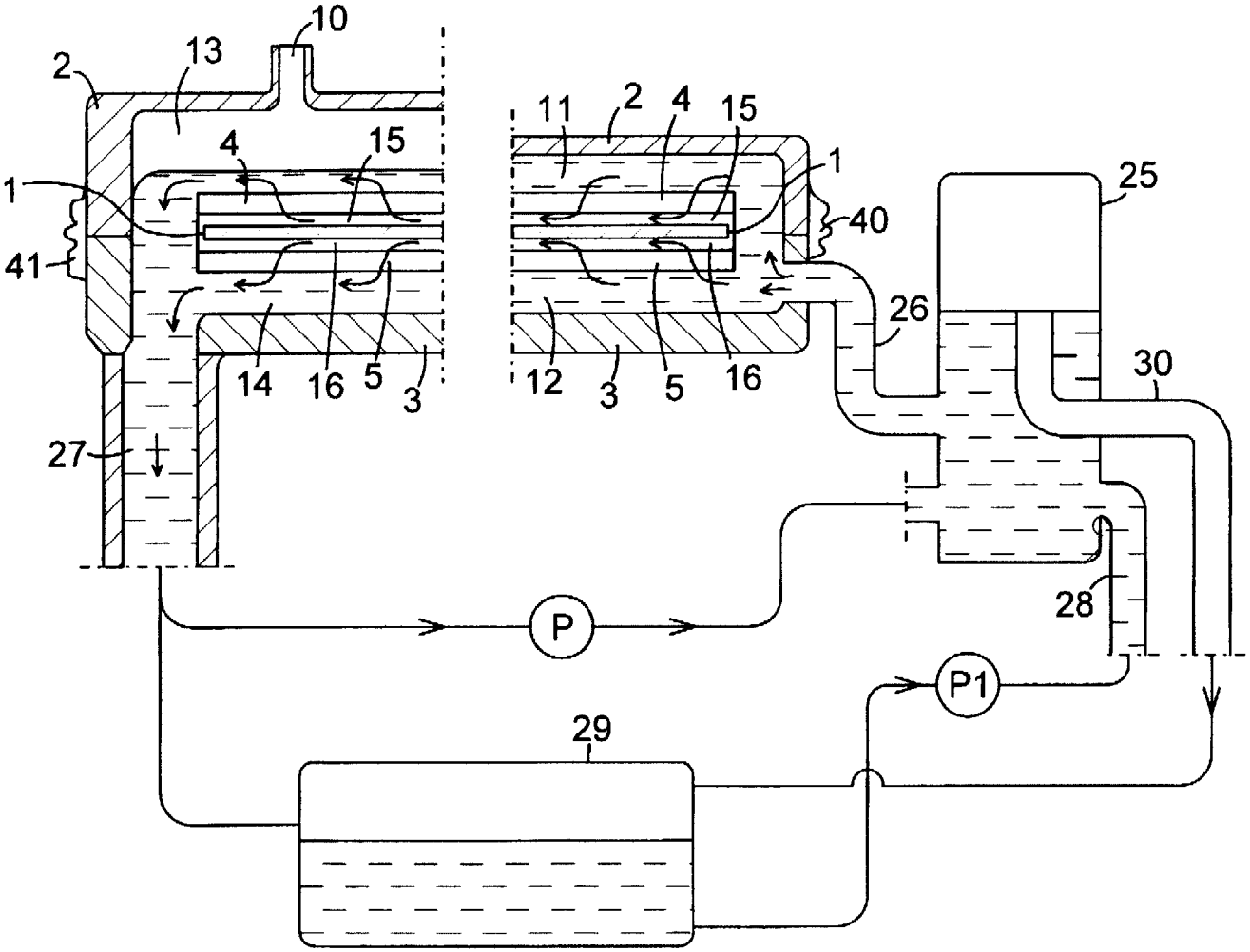

FIG. 3 shows the flow of liquid through the cell. FIG. 3A shows the level tank 25 with electrolyte and a coarse connecting tube 26 connected to the lower cell half 3. Via the inlet channels 11, 12, resp., the electrolyte passes into the crevices 15,16 between the graphite electrodes 4,5 and the strip 1. FIG. 3B shows how the electrolyte flows out of the cell via outlet channel 13 and 14 and then the electrolyte falls freely in a coarse tube 27 connected to a centrifugal pump P and further back to the level tank 25. The electrolyte can also fall freely down into a big supply 29 below the cells and can then be pumped to the level tank 25 through connection tube 28 via pump P1. To prevent overflow there is an overflow drain tube 30 mounted in the level tank for return flow to the supply tank. A fan outlet 10 is connected to a strong fan giving a big negative pressure in the cell, and thereby sucks the electrolyte in and makes the electrolyte level in the cell higher than the level in the level tank 25, and removes all formed gases. Tightenings 40, 41 at the cell edges parallel to the feeding direction of the strip are schematicly drawn and are shaped as bellows. This allows a variation of the electrode distance in the cell.

The electrolytic pickling according to the invention is initiated by feeding the strip into the cell via guidance rolls 21, 22, see FIG. 1, further between the cell halves 2,3, which can be separated automatically , so a big crevice is obtained when feeding in a new strip, and further out between the guidance rolls 23,24. The cell halves are brought together and the pump P (alternatively P1) is started and thereafter fans are started for evacuation of the cell via the fan outlet 10. The electrolyte now begins to circulate through the cell, when via the connection tube 26 it is sucked into the cell up to a drawn equilibrium level in the outlet channel 13, and then it falls down into the tube 27 and is pumped back to the level tank 25. Then the alternating current to the graphite electrodes is switched on and electrolytical pickling of the two surfaces of the strip starts. The strip is then fed through the cell continuously. Gas bubbles and sludge, formed at the pickling, are driven away from the surfaces of the electrodes and the strip by the heavy electrolyte flow and can be separated out in filters or the like. The electrolyte flow chills also and removes reaction heat from the process.

If strips narrower than the electrodes are to be pickled, current shielding plates can be disposed at the edges of the strip to prevent the current to pass directly between the electrodes which else would give effect losses.

The principle of the electrolytic pickling in acid with alternating current according to the invention is that the alternating current goes from the graphite electrode to the strip via the upper electrolyte and passes perpendicularly straight through the strip in its thickness direction and further via the lower electrolyte to the opposite graphite electrode. The two electrolytes are separated from each other by the strip and if necessary by isolating plates.

By the invention it has surprisingly turned out that an increased pickling effect in pickling of strips is obtained using electrolytic pickling in mineral acids or mixtures of them with alternating current or polarity reversed direct current. A surface without chromium depletion is obtained, if the principle of passing an alternating current or polarity reversed direct current straight through the strip in its thickness direction is used, and , instead of what is said in the Swedish patent 132 298, the combination of graphite electrodes and liquid contact is used. The graphite electrodes in combination with alternating current have also the advantage that acid will not be consumed for pickling of the electrode which would be the case using electrodes of stainless steel. According to the invention it has also surprisingly turned out that the wear of the graphite electrodes in combination with alternating current is very low, quite contrary to what is said in EP-A1-137 369, where it is also obvious from the wiring diagram that the alternating current is not to be passed perpendicularly through the strip, but along the strip to auxiliary help electrodes.

It is known by U.S. Pat. No. 4,276,133 and EP-A1-209 168 that wire can be pickled electrolyticly and continuously in acids at a high current density (200 A/dm$^2$) in partly closed systems. The method according to these documents is that the current is not passing in the thickness direction, but passes from anode to wire, follows the wire a certain distance and then leaves the wire to go to the cathode. However, for continuously travelling strips, several of the parameters (material area, total current, acid leak at in- and outlets of the cell, non-flatness etc) will be at least 100 times bigger than for wire, and as a consequence such a wire pickling technique cannot, in practice, be transferred to a corresponding technique for strip pickling.

Abstract of JP-A-60-135 600 shows a construction with direct current, where the current is led in the thickness direction of the strip, and the strip is pickled alternating on its two surfaces between electrode pairs, where the pairs must be separated from each other in the feeding direction of the strip to prevent the current to pass directly in the bath between, in the feeding direction of the strip, adjacent electrodes. This causes problems with unnecessarily long total length of pickling lines. Further such a construction is not applicable to mineral acid, which has about 5 times higher conductivity than salt solutions, and then a still bigger separation between different electrode pairs in the feeding direction of the strip would be required. The document does not say how to obtain a high current density, from a process technical point of view as in the present invention, in pickling of stainless steel in mineral acid.

Further, surprisingly, the device according to the invention gives a solution of the problem with acid leak at in- and outlets of the continuously travelling strip, which can be 2 m wide and furthermore can have more or less dents and knobs.

It is particularly surprising as U.S. Pat. No. 4,276,133 shows that they not even for wire have thought of a sufficient tightening at continuous passage through the cell wall, but use overflow protection, which is reasonable for the relatively small overflow volumes in pickling of wire. For pickling of strip this principle is not reasonable due to the bigger overflow volumes.

The construction with graphite electrodes in cell halves means also that the active volume of acid is considerably smaller than in conventional pickling in mixed acid. A system for transport of acid in narrow crevices in pickling of mild steel strips is described in EP 0 276 384. However, the system is only intended for chemical pickling of mild steel in acid.

It should be observed that the pickling effect ( the volume of material removed by pickling) is proportional to the current density (A/dm$^2$). The invention allows high currents to pass through the strip, in spite of the fact that graphite with a conductivity about 350 times less than that of copper, must be chosen due to the acid environment and corrosion considerations. The short way of the current through the crevices with electrolyte and the supply of current to the graphite electrodes from many points through the thickness direction, give a low voltage decrease and thus just small effect losses are obtained. An industrial pickling line for neutral pickling is often supplied by 20 V and then a current of 20 000 A will pass the strip, while according to the invention, only 8 V will give a current of 50 000 A. In both the cases the effect will be 400 kW, but 2.5 times higher pickling effect is obtained by the invention.

The technical effect is also shown by the following examples and by these and the previous description the effect of the invention can be summarized:

As a whole, the invention can be considered as a challenge of the natural laws, where it has surprisingly turned out that it is possible to considerably increase the pickling effect by combining a fast circulating flow, produced by evacuation, of electrolyte in an electrolytic cell and supply of current in the thickness direction of the strip, and that, at the same time, it is possible to overcome the environmental and safety problems related to continuous passage of very big lengths of stainless steel strips in in- and outlets to strong acids at a high temperature. A further environmental effect is that the invention, by the use of sulphuric acid, completely eliminates the problem with nitrogen oxides from use of nitric acid and the problem with handling of the fluoric acid.

EXAMPLE 1

For a high alloy stainless steel with 20% Cr, 18% Ni, 6% Mo and 0.2% N strips were produced with a thickness of 0.8 mm. After annealing the strip was pickled electrolyticly in a neutral salt solution of $Na_2SO_4$, whereafter the strip passed a brushing stage, where rests of oxide were removed. Final pickling was performed in mixed acid (5% HF/20% $HNO_3$) Samples from the strip were examined in an electron probe microanalyser (EPMA) and the chromium content in the surface was determined with this instrument. The surface structure had relatively smooth scratches by the brushing and between the scratches there were pickled areas where the grain structure was clearly apparent. The chromium content in the scratches was 19.88%, whereas it was only 16.58% in the pickled areas, thus locally, the surface was strongly chromium depleted. According to the invention a test plate of the strip material was pickled for 55 s at 200 A/dm$^2$ and 8 V in 30% $H_2SO_4$. Surface analysis with electron microprobe analyser was performed and the surface content was 19.9%, thus no remaining chromium depletion. The structure was now uniform without any overpickling.

The pitting properties of the surface was tested in 1M NaCl, according to ASTM G61, with the so called Avesta cell. The chromium depleted specimen had a relatively low CPT (Critical Pitting Temperature) of 70° C., whereas the specimen pickled according to the invention had CPT 92° C. Ground bulk material, in both the cases, had CPT 92° C.

EXAMPLE 2

A conventional pickling line for 1.6 m wide stainless steel strips and a strip speed 10 m/min contained a neolyte pickling unit and 3 acid baths with HF+$HNO_3$, each 20 m long, and a shot blasting machine. The total length of the full pickling line was 90 m. To double the production the strip speed would be increased to 20 m/min and a calculus was performed for a new pickling line based upon test results from full scale tests of a pickling line according to the invention. With only 20 cells according to the invention and ditto roll pairs between the cells, a complete pickling line could be calculated to have a length of only 30 m ( about ⅓ of that of the previous line, but with the double capacity), and where the environmentally dangerous mixture of 5%HF/20%$HNO_3$ could be replaced by 30% $H_2SO_4$. The cost of the investment was calculated to be half of that of the conventional, previous technique and permittance for the production could be obtained from the environmental authority in spite of the production being doubled.

EXAMPLE 3

Full scale tests with a cell according to the invention was performed with the following parameters and were compared with conventional pickling.

| | The invention | | | Conv.tech |
|---|---|---|---|---|
| Material | AISI 304 | AISI 3 | 254SMO | 254SMO |
| Width, mm | 1500 | 1200 | 900 | 900 |
| Thickness, mm | 3 | 2 | 1 | 1 |
| Pickling time,sec | 15 | 20 | 60 | 120 |
| Voltage, V | 8 | 8 | 8 | — |
| Current, kA | 30 | 24 | 18 | — |
| Effect, kW | 240 | 192 | 144 | — |
| Acid | | Sulphuric acid | | HF + $HNO_3$ |
| Acid conc. % | 25 | 30 | 35 | 5% + 20% |
| Temp., °C. | 60 | 60 | 60 | 50 |
| Acid flow, l/min | 800 | 700 | 600 | — |
| Oxide rests, visible | No | No | No | No |
| Corrosion test, CPT | — | — | 92° C. | 70° C. |

After passage of 50 km continuous strip through a test cell according to the invention with 30% sulphuric acid, 60° C., the wear of the tightening strips was measured and was 0.1 mm in the points 35, 36, which gives a running time of about a month and the exchange of the tightening strips is performed in some minutes without having to stop the pickling process. In conventional technique the process must be stopped and emptying of baths and exchange of rolls take several hours.

The test cell according to the invention had no leak of electrolyte. No scratches were formed in the strip surface by the tightening strips.

EXAMPLE 4

Process technically and from safety point of view, the cells according to the invention have been tested how fast the cell can be emptied and opened if strips with mechanical defects, welded joints etc must pass in a continuous annealing/pickling line. There are two cases, demands for pickling with limited strip speed and totally interrupted pickling, resp. It has then turned out that the system easily allows an increase of the electrode distance because the tightening strips 6–9 and the bellows 40,41 allow bigger distance between the cell halves 2,3. Total emptying of the acid in the cell has surprisingly turned out to be performed in less than a second, in spite of the acid flow being up to 1000 l/min while pickling is going on. The evacuation via outlet 10 is switched off and the electrolyte streams down into channel 27 or back to the level tank 25 and the process is stopped immediately.

What is claimed is:

1. A method of electrolytically pickling of a metal in the form of plates or strips which comprises the steps of:

a) providing an electrolytic bath containing an electrochemical cell and a electrolyte circulating in a closed system, said electrochemical cell comprising two cell halves containing an electrode in each;

b) forming a crevice between the metal and each electrode;

c) passing said electrolyte at an elevated speed through each of said crevices; and d) passing a controlled electric current through one of said electrodes, passing current through said electrolyte, through said metal in the thickness direction of said metal and through the electrolyte to the other electrode.

2. The method according to claim 1, wherein said metal comprises stainless steel.

3. The method according to claim 2, wherein said stainless steel comprises high alloy stainless steel in the form of a strip.

4. The method according to claim 1, wherein said electrical current comprises a current selected from the group consisting of alternating current and direct current.

5. The method according to claim 1, wherein said electrical current has a current density of at least about 150 $A/dm^2$.

6. The method according to claim 1, wherein said electrical current has a voltage of about up to 8 V.

7. The method according to claim 1, wherein said electrolyte bath comprises a mineral acid.

8. The method of claim 7 wherein said mineral acid is selected from the group consisting of HF, $HNO_3$ and $H_2SO_4$.

9. The method according to claim 1, wherein said electrolyte bath comprises sulfuric acid.

10. The method according to claim 9, wherein said sulfuric acid has a concentration of about 10 to 40 percent in volume.

11. The method according to claim 1, further comprising means for tightening said metal as it passes through said electrochemical cell.

12. A device for electrolytic pickling of a metal strip, said pickling device comprising:

an electrolytic bath, said electrolyte bath containing an electrochemical cell and an electrolyte circulating through a closed system;

means for feeding said metal through said bath;

said electrochemical cell consisting of two cell halves and two electrodes, each cell half having one of said electrodes;

said first electrode being situated so as to be above said strip and forming a first crevice therebetween;

said second electrode being situated so as to be below said strip and forming a second crevice;

each electrode having opposite polarities and being chemically resistant to said electrolyte;

whereby when said strip is fed in between said electrodes and an electrical current is passed from said first electrode, through said first crevice, through said metal, through said second crevice and to said second electrode there is a resulting electrolytic pickling of said metal.

13. A pickling device according to claim 12 further comprising means for tightening said metal as it passes through said electrochemical cell.

14. A pickling device according to claim 13, wherein said tightening means is spring loaded.

15. A pickling device according to claim 13, further comprising bellows to separate said cell halves during said electrolytic pickling process.

16. A pickling device according to claim 13, wherein said tightening means comprises at least four tightening strips; two of said tightening strips being situated above and below said metal at one end of said pickling device and said other two tightening strips being situated above and below said metal at the other end of said pickling device.

* * * * *